US006347857B1

(12) United States Patent
Purcell et al.

(10) Patent No.: US 6,347,857 B1
(45) Date of Patent: Feb. 19, 2002

(54) INK DROPLET ANALYSIS APPARATUS

(75) Inventors: David A. Purcell, San Diego; David A. Neese, Escondido; Warren Free, Anaheim, all of CA (US)

(73) Assignee: Encad, Inc., San Diego, CA (US)

( * ) Notice: Subject to any disclaimer, the term of this patent is extended or adjusted under 35 U.S.C. 154(b) by 0 days.

(21) Appl. No.: 09/404,558

(22) Filed: Sep. 23, 1999

(51) Int. Cl.[7] ..... B41J 29/393

(52) U.S. Cl. ..... 347/19

(58) Field of Search ..... 347/19, 22, 104, 347/105; 250/222.1, 559.01, 559.04, 559.05, 559.06, 559.08, 559.2

(56) References Cited

U.S. PATENT DOCUMENTS

| | | | | | |
|---|---|---|---|---|---|
| 4,255,754 | A | | 3/1981 | Crean et al. | 347/81 |
| 4,323,905 | A | | 4/1982 | Reitberger et al. | 347/6 |
| 4,328,504 | A | | 5/1982 | Weber et al. | 347/14 |
| 4,369,456 | A | | 1/1983 | Cruz-Uribe et al. | 347/33 |
| 4,392,142 | A | | 7/1983 | Seachman et al. | 347/81 |
| 4,410,895 | A | | 10/1983 | Houston et al. | 347/81 |
| 4,493,993 | A | * | 1/1985 | Kanamuller et al. | 250/222.1 |
| 4,510,504 | A | | 4/1985 | Tamai et al. | 347/81 |
| 4,550,322 | A | | 10/1985 | Tamai | 347/81 |
| 4,551,731 | A | | 11/1985 | Lewis et al. | 347/78 |
| 4,577,197 | A | | 3/1986 | Crean et al. | 347/6 |
| 4,609,779 | A | * | 9/1986 | Rogers | 379/100.01 |
| 4,636,805 | A | * | 1/1987 | Toganoh et al. | 347/105 |
| 4,701,771 | A | | 10/1987 | Ikeda | 347/36 |
| 4,725,891 | A | * | 2/1988 | Manian | 358/406 |
| 4,751,517 | A | | 6/1988 | Crean et al. | 347/81 |
| 4,755,877 | A | | 7/1988 | Vollert | 358/401 |
| 4,907,013 | A | | 3/1990 | Hubbard et al. | 347/19 |
| 5,140,429 | A | | 8/1992 | Ebinuma et al. | 358/296 |
| 5,146,087 | A | | 9/1992 | VanDusen | 399/2 |
| 5,194,720 | A | * | 3/1993 | Reinnagel et al. | 235/437 |
| 5,212,497 | A | | 5/1993 | Stanley et al. | 347/19 |
| 5,250,956 | A | | 10/1993 | Haselby et al. | 347/19 |
| 5,255,009 | A | | 10/1993 | Bauer | 346/25 |
| 5,276,467 | A | | 1/1994 | Meyer et al. | 347/19 |
| 5,289,208 | A | | 2/1994 | Haselby | 347/19 |
| 5,297,017 | A | | 3/1994 | Haselby et al. | 347/19 |
| 5,343,231 | A | * | 8/1994 | Suzuki | 347/14 |
| 5,350,929 | A | | 9/1994 | Meyer et al. | 250/573 |
| 5,353,052 | A | | 10/1994 | Suzuki et al. | 347/19 |
| 5,434,605 | A | | 7/1995 | Osborne | 347/23 |
| 5,473,351 | A | | 12/1995 | Helterline et al. | 347/19 |
| 5,477,244 | A | | 12/1995 | Shibata et al. | 347/19 |
| 5,517,217 | A | | 5/1996 | Haselby et al. | 347/23 |
| 5,530,462 | A | | 6/1996 | Takahashi et al. | 347/23 |
| 5,568,172 | A | | 10/1996 | Cowger | 347/19 |
| 5,596,353 | A | | 1/1997 | Takada et al. | 347/19 |
| 5,627,571 | A | | 5/1997 | Anderson et al. | 347/19 |
| 5,644,344 | A | | 7/1997 | Haselby | 347/19 |
| 5,691,533 | A | * | 11/1997 | Freeman et al. | 250/222.1 |
| 5,712,666 | A | | 1/1998 | Matsubara et al. | 347/19 |
| 5,721,434 | A | * | 2/1998 | Siegel et al. | 250/559.1 |
| 5,734,405 | A | | 3/1998 | Suzuki | 347/105 |
| 5,768,991 | A | * | 6/1998 | Cless et al. | 101/227 |
| 5,771,051 | A | | 6/1998 | Guenther et al. | 347/19 |
| 5,798,773 | A | * | 8/1998 | Hiramatsu et al. | 347/19 |
| 5,835,108 | A | * | 11/1998 | Beauchamp et al. | 347/19 |
| 6,015,200 | A | * | 1/2000 | Ogura | 347/3 |

FOREIGN PATENT DOCUMENTS

| | | | | |
|---|---|---|---|---|
| EP | 0 443 832 B1 | | 12/1996 | |
| EP | 0 568 283 B1 | | 12/1999 | |
| JP | 56-46767 A | * | 4/1981 | B41J/3/04 |

OTHER PUBLICATIONS

Japanese Abstract No. 58–183265, Oct. 26, 1983.
Japanese Abstract No. 06–340063, Dec. 13, 1994.

* cited by examiner

*Primary Examiner*—John Barlow
*Assistant Examiner*—Blaise L Mouttet
(74) *Attorney, Agent, or Firm*—Knobbe Martens Olson & Bear LLP

(57) ABSTRACT

A droplet deposition analysis system for an ink jet printer including a flexible transparent substrate. The printer may include a light source on one side of the substrate, and an optical detector on the other side of the substrate.

33 Claims, 8 Drawing Sheets

INK DROPLET ANALYSIS APPARATUS

BACKGROUND OF THE INVENTION

In an ink jet printing process, individual drops of dye or pigment are deposited onto a substrate with on demand droplet deposition devices comprising dozens or hundreds of individual nozzles spaced typically 1/300 or 1/600 inches apart. The image quality possible with color ink jet printers now approaches photorealistic. It can be appreciated that to produce such high quality images, the nozzles on the droplet deposition devices should be functioning properly, and should be depositing droplets precisely onto the desired locations on the substrate. In some cases, a single malfunctioning nozzle out of the hundreds which are depositing droplets can have a noticeable effect on image quality.

A number of different techniques for evaluating nozzle function have been developed. In some systems, the existence and trajectory of the ink droplets is detected as the droplet moves through the air between the nozzle and the substrate. One example of a system of this type is described in U.S. Pat. No. 4,510,504 to Tamai et al. In other systems, droplets are ejected onto the print substrate, and are optically detected from above. This technique is utilized in some commercially available products from, for example, Hewlett-Packard, of Palo Alto, Calif. and ColorSpan Corp. of Eden Prairie, Minn. These detection systems typically include one or more LED light sources and an optical detector mounted on the moveable print carriage. The detector senses LED light reflected from the substrate, and the properties of this reflected light are analyzed. Such designs require the use and disposal of a certain amount of media, which can be very expensive in high quality image production. Furthermore, the accuracy and sensitivity of these systems is greatly impaired when coarse or uneven media such as canvas is being printed.

Another system is shown in U.S. Pat. No. 4,493,993 to Kanamuller et al. In the Kanamuller patent, droplets are deposited onto a rotating transparent disk. The presence of individual droplets is detected by a detector on the other side of the disk. The deposited droplets are wiped off of the disk after detection by passing the disk across an absorbing pad. The Kanamuller system is limited in that certain types of nozzle malfunctions are difficult or impossible to detect. The system of Kanamuller also requires a relatively messy cleaning system. Improved methods of evaluating nozzle functionality are therefore needed in the art.

SUMMARY OF THE INVENTION

The invention comprises an inexpensive and fast method of droplet deposition analysis in an ink jet printer. Advantageous apparatus for performing the method is also provided. In one embodiment, an apparatus for droplet deposition analysis comprises a strip of substantially transparent and flexible film. The film may have a light source mounted on one side and an optical detector on the other. The use of flexible film produces a less expensive and more consistent droplet deposition analysis than is found in the prior art.

Advantageous droplet analysis methods provided by the invention include depositing an array of ink droplets onto a transparent substrate, passing light through the transparent substrate and into an optical detector so as to detect said array of ink droplets, mapping the array of ink droplets onto a coordinate field, and detecting at least one ink droplet which is incorrectly placed relative to the coordinate field.

Advantageously, such methods and apparatus are implemented in ink jet printers to produce higher quality print output in a shorter time, and with less material waste.

DETAILED DESCRIPTION OF THE INVENTION

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the invention herein described.

Figure 1:
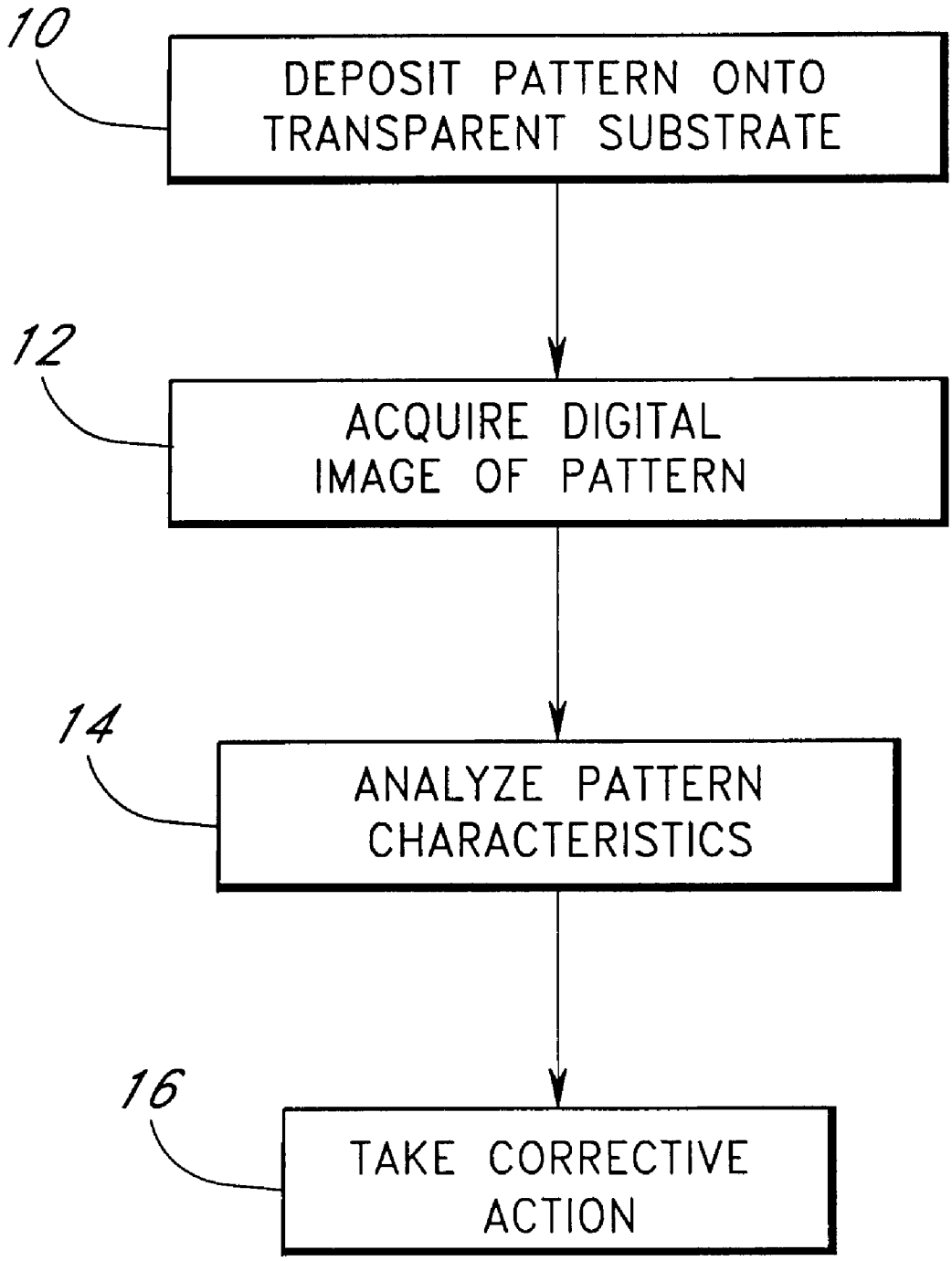
FIG. 1 is a flowchart of a method of ink jet head functional evaluation in one embodiment of the invention.

The invention provides a droplet analysis system for ink jet printers. The system, which may be made an integral part of an ink jet printer, includes a substrate onto which the printer deposits a test print pattern. In some embodiments, the substrate may comprise a transparent material. Referring now to FIG. 1, one embodiment of a method of ink jet nozzle evaluation begins at block 10, where the ink jet nozzles of the printer deposit a pattern of ink droplets onto a transparent substrate. Next, at block 12, a digital image of the pattern is acquired. One suitable deposition and image acquisition apparatus is described in detail below with reference to FIGS. 2–7. At block 14, the digital image data is analyzed. The analysis advantageously produces a characterization of the performance of each nozzle on the ink jet print head. The information produced by the system may in some embodiments include indications of non-existent firing, misdirected firing, drop volume errors, and ink color discrepancies. At step 16, corrective action may be taken. This may include attempts to prime or clear the nozzles, or may involve replacing defective nozzles with spare nozzles or compensating for defective nozzles with other functional nozzles.

Figure 2:
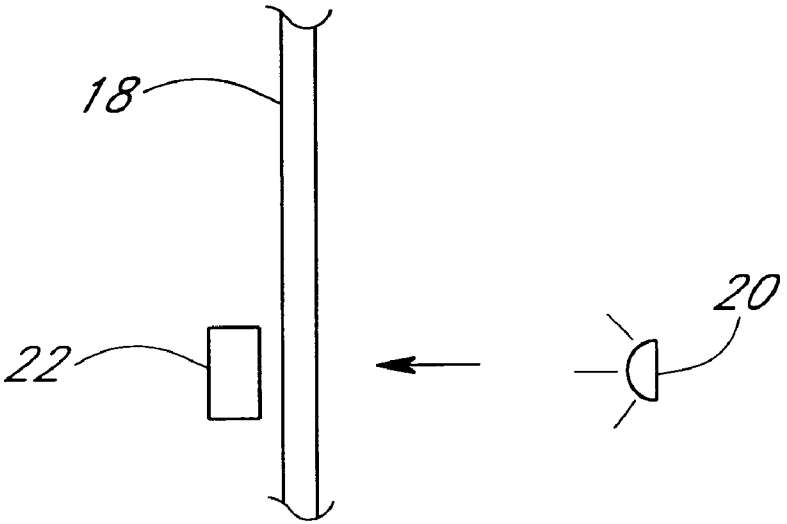
FIG. 2 is a cutaway side view of a droplet pattern image acquisition apparatus according to one embodiment of the invention.

In FIG. 2, a droplet analysis system is illustrated which comprises a strip of substantially transparent film 18. The strip 18 may advantageously comprise a commercially available polyester film having a thickness of less than approximately 5 mils. In one embodiment, a thickness of 1–2 mils has been found suitable. Depending on the type of ink being used in the printer, it may be advantageous to coat the film with a binder so that the droplets adhere to the surface of the film and show deposition characteristics similar to what will occur during the normal print process on the media to be used with the printer.

On one side of the film 18 is a light source 20, and on the opposite side of the film 18 is an optical detector 22. As will be explained in additional detail below, operation of the system involves the selective deposition of ink droplets onto the film 18. Light from the light source 20 may be blocked by the presence of ink droplets on the film 18 between the light source 20 and the optical detector 22. The presence and position of deposited ink may be detected by analyzing the output of the optical detector 22.

In applications involving ink jet printing, the deposited droplets will be of several different colors and will not be totally opaque. As the different color inks will exhibit different absorbance characteristics for different color incident light, it is advantageous to use a light source which can emit light of different colors. For example, the light source may comprise two or three different color light-emitting diodes (LEDs). In one especially advantageous embodiment, red, green, and blue LED's sequentially illuminate the deposited ink. With separate absorbance measurements for red, green, and blue light by a region of deposited ink, complete information regarding the color of the ink in that region is obtained, regardless of the ink color set used by the ink jet printer. It is possible to substitute an amber LED for the red and green LED's described above. However, this system does not provide complete and unambiguous color information from only amber and blue absorbance measurements.

An alternative to the use of several separate and different color light sources is to utilize white light and a color detector such as a commercially available color charge-coupled device (CCD) array. In other embodiments, a white light source may be combined with a non-color sensitive detector and external filtering may be provided between the light source and the detector. In these embodiments, the filter may be placed above the film 18, or may be incorporated into the film 18 itself. In the first embodiment, the filter may comprise a two or three segment colored plate or disk which is positioned to make the light which impinges on the film 18 the desired color. In the latter embodiment, the film will include regions colored in a translucent red, green, and blue, for example.

In use, the apparatus illustrated in FIG. 2 is affixed to an ink jet printer. The printer will print a pre-selected pattern of ink droplets onto the film 18, and the printer will also include data processing circuitry for analyzing the output of the optical detector 22 to detect malfunctioning ink jet nozzles.

The light source 20, film 18, and optical detector 22 may be affixed in many alternative ways to the frame or other components of an ink jet printer. In one embodiment, described in more detail below, the light source and optical detector are inside the printer, beneath the printer platen, and the film is routed from the printing surface into the printer and between the light source and optical detector. This reduces ambient light and accordingly increases the signal to noise ratio at the detector 22. In some embodiments, the film is provided on the printer platen surface, and the light source 20 is fixed to a moving print carriage provided as part of the ink jet printer. Alternatively, the light source 20 may be fixed to the frame of the printer or other stationary location on the printer above the film 18.

Figure 3:
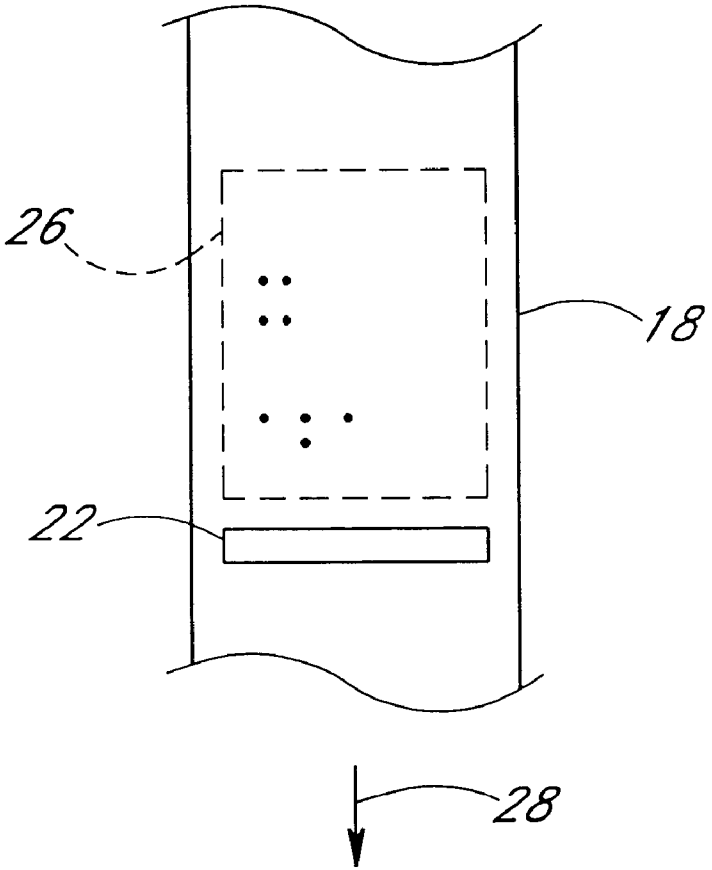
FIG. 3 is a front view of the droplet pattern image acquisition apparatus of FIG. 1.

FIG. 3 shows a front view of one embodiment of an image acquisition system as shown in side view in FIG. 2. In some advantageous embodiments, and as illustrated in FIG. 3, the optical detector 22 comprises a linear array of a plurality of discrete light detecting elements such as charge coupled devices (CCDs) or photodiodes. The film 18 is positioned over the optical detector 22, and may be scrolled past the optical detector 22 in the direction of arrow 28. On the film 18 is a region 26 that includes deposited ink droplets. These may comprise separated individual droplets or adjacent multi-droplet regions of ink. As will be described in detail below with reference to FIGS. 6 and 7, a specific pattern of ink deposition may be utilized which provides advantageous analysis characteristics for identifying deposition faults and associating those faults with appropriate nozzles and corrective action.

As the film 18 is scrolled past the detector 22, light from the light source 20 will be selectively blocked by the presence of the deposited ink in the region 26. It will be appreciated that if the output of the detector is acquired as the film 18 is scrolled past the detector 22, a two-dimensional digital image of the pattern of deposited ink in the region 26 may be created which can be analyzed with digital processing techniques in the ink jet printer. Of course, it will be appreciated that the optical detector may alternatively comprise a two-dimensional array of light sensitive elements. Specific advantageous embodiments of deposition and analysis techniques are described below.

Figure 4:
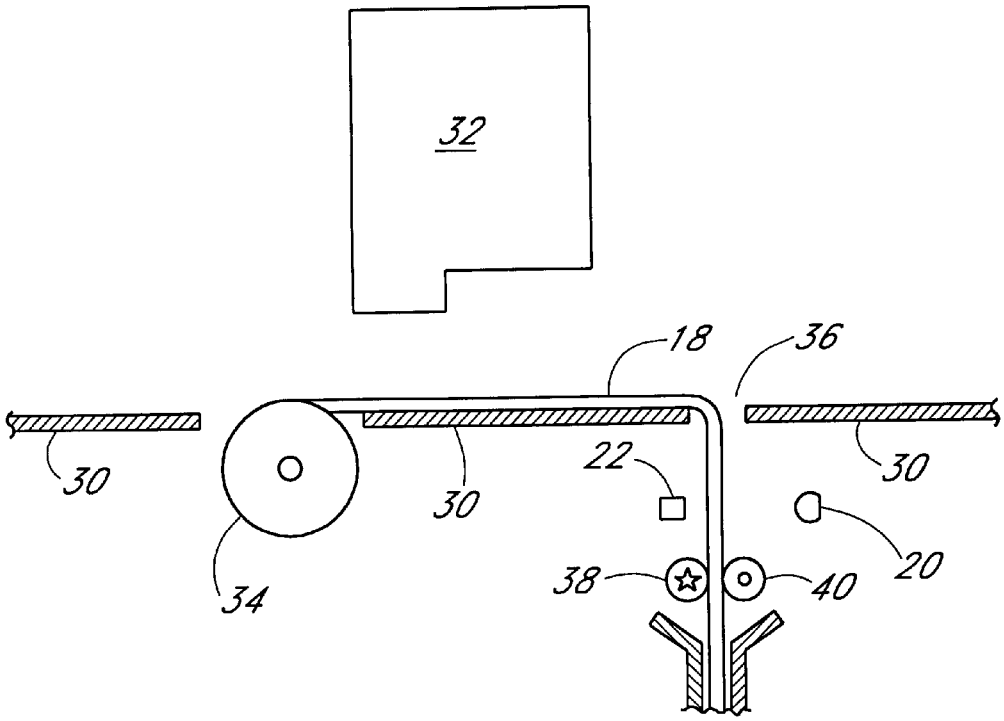
FIG. 4 is a cutaway partial side view of an ink jet printer incorporating droplet pattern acquisition apparatus in accordance with one embodiment of the invention.

FIG. 4 illustrates one embodiment of an ink jet printer which includes the droplet deposition analysis of FIGS. 2 and 3 incorporated therein. As is well known to those of skill in the art, the printer includes a platen surface 30 which is adjacent to one or more ink jet cartridges 32 for selective deposition of ink onto a substrate such as paper, fabric, etc. In many common printer embodiments, four ink jet cartridges are utilized which are mounted to a moveable print carriage (not shown). The print carriage passes back and forth across the platen, and the substrate is incremented with each pass of the ink jet cartridge to produce a complete two-dimensional image. In FIG. 4, the cartridge 32 is illustrated above the platen 30, as is the case for many commercially available large format ink jet printers, although ink deposition may alternatively be horizontally directed onto a vertically oriented substrate.

In the printer implementation of FIG. 4, the film 18 is wound onto a supply reel 34 which is removably mounted in the platen 30 surface. The supply reel is advantageously mounted near the right or left end of the platen 30, to the side of the path of substrate material during normal printing operations. In some advantageous embodiments, the supply reel 34 and path of transparent film 18 is adjacent to a print cartridge service station which is provided at one end of the platen. As is also well known to those of skill in the art, most ink jet printers are provided with service stations for wiping and capping the ink ejection nozzles between (and perhaps during) print operations.

In the embodiment of FIG. 4, the film 18 on the supply reel 34 extends across the platen 30 beneath travel path of the ink jet cartridges 32. The film 18 may then extend into the inside of the printer through a slot 36. Mounted beneath the slot 36 is the optical detector 22 and the light source 20 as described above with reference to FIGS. 2 and 3. Many commercial sources of suitable detectors and LEDs exist. For example, in one embodiment, the detector is the model TSL 214, 256 pixel, 400 pixel per inch linear photodiode array from Texas Instruments. Detector resolution may vary widely and remain adequately functional. In fact, with appropriate image analysis techniques, such as are described in greater detail below, the resolution of the detector may be significantly lower than the resolution of the printer itself. Thus, the 400 pixel-per-inch detector described above is suitable for a 300 or 600 dpi printer. Suitable LEDs in these embodiments are also widely available, with on-state output intensity and cost being the main relevant factors in the selection of particular vendors.

Below the detector 22 and light source 20 is a pinch roller 40 and a drive capstan 38. The drive capstan 38 may be coupled to a stepper motor (not shown) so that the film 18 is incremented past the detector 22 and light source 20 by the rolling action of the drive capstan 38. After scrolling past the detector 22, the film 18 may be routed into a waste receptacle either internal or external to the printer housing. It is preferable to have the drive capstan 38 engaged with the non-printed side of the substrate 18.

The method of implementing the image acquisition apparatus illustrated in FIG. 4 has several advantageous aspects. Positioning the detector 22 and light source 20 under the platen surface 30 reduces the amount of ambient light impinging on the detector 22, thereby improving the signal to noise ratio at the detector 22. In addition, very simple and convenient film replenishment is possible. For example, the supply reel may be a disposable cartridge of transparent film which may be manually replaced by the user when empty with a fresh disposable supply reel in a manner analagous to replacing a roll of photographic film in a camera. Installation of the film cartridge could be completed by inserting the end of the film 18 through the slot and between the mated pinch roller 40 and drive capstan 38. Rotation of the capstan 38 would then pull a segment of film 18 downward toward the waste receptacle, thereby positioning the film for subsequent printing and droplet deposition analysis.

Many conventional ink droplet analysis mechanisms deposit ink onto the actual print substrate being used to perform the subsequent print job. This ink may be detected using a light source and detector mounted above the substrate on the print carriage, for example. These systems are subject to significant amounts of ambient light noise. They also use up expensive print media, which may cost over $1 per square foot, in contrast to the cost of the film 18, which costs a small fraction of that. If thick, heavy, or irregular media is being used such as vinyl, canvas, or some textiles, the information obtained by these conventional systems may be difficult to interpret or even totally unusable. The dedicated film 18 provides a consistent and repeatable test procedure at a low price. As will be explained further below, the speed with which droplet deposition information may be collected by the system of FIGS. 2–4 is also a significant improvement over many currently available systems.

Figure 5:
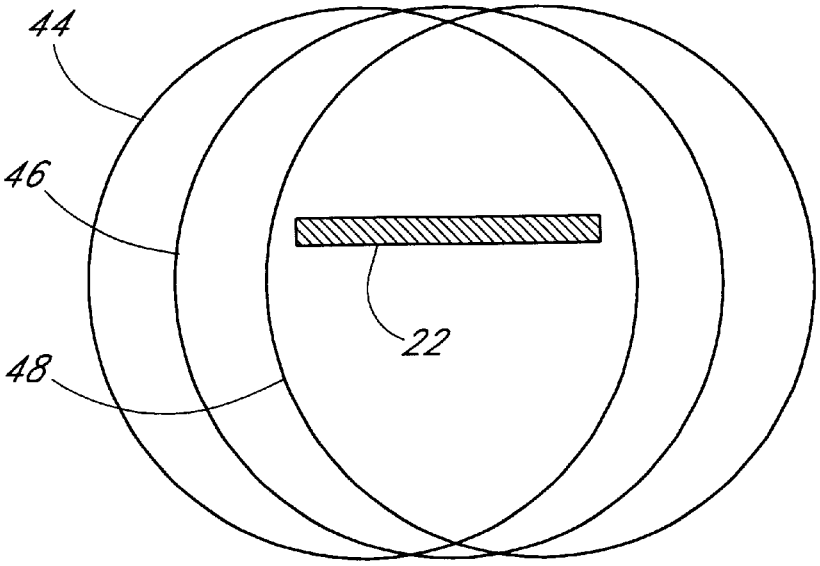
FIG. 5 is a schematic view of a multi-led illumination pattern of a detector suitable for use with the present invention.

Turning now to the light source 20 and its relationship to the detector 22, FIG. 5 illustrates three overlapping illumination fields 44, 46, 48 produced by closely spaced red, green, and blue LEDs which make up one advantageous LED array embodiment of the light source 20. In one advantageous embodiment, the entire detector 22 is within the illumination field of each of the LEDs. The illumination fields 44, 46, 48 may, for example, be each approximately one inch in diameter. If the detector 22 comprises a linear array of 256 photodiodes spaced at 400 photodiodes per inch as described above, the width of the detector 22 array is about 0.64 inches. As is well known in the art, due to the internal mechanical construction of commercially available LEDs, the illumination fields 44, 46, and 48 may comprise two or three concentric bands having different light intensities, and will typically include a low intensity region near the center of the illuminated field. In order to provide the most consistent baseline intensity profile across the entire detector 22, the detector is advantageously positioned off center (vertically in FIG. 5) within the illumination fields 44, 46, 48 to avoid spanning a region of low intensity emission from the LEDs. These effects may also be addressed by having more than one LED for each color, and/or by aiming the LEDs so that the illuminated regions have a more complete overlap.

With overlapping illumination, it is possible to take a reading across the entire photodetector with each separate LED. In operation, therefore, the red LED producing illumination field 44 is turned on, and the collected light energy from each of the 256 photodiodes is measured and stored in the printer data processing circuitry. The red LED is then shut off, and the green LED producing illumination field 46 is turned on. Once again, the collected light energy from each of the 256 photodiodes is measured and stored in the printer data processing circuitry. Finally, the green LED is turned off and the blue LED producing illumination field 48 is turned on, and the collected light energy is measured and stored a third time. After these three data gathering steps, the film 18 is incremented, and the multiple illumination and data collection process is repeated. The film 18 may be advanced during data acquisition by the same increments as used during the ink deposition process. Therefore, the resolution of system in the direction perpendicular to the detector array 14 may be different from the 400 dpi horizontal resolution of the array itself. It will be appreciated that sequential repetition of these data gathering and incrementing steps over the region 26 of the film 18 which contains a pattern of ink deposition will result in three two dimensional images of the ink deposited in the region 26 at a 400 dpi resolution in horizontal dimension, and typically 300 or 600 dpi resolution in the vertical dimension. One image will indicate red light attenuation by deposited ink, one will indicate green light attenuation by deposited ink, and one will indicate blue light attenuation by deposited ink.

In many advantageous embodiments, each individual pixel of the photodetector array 22 outputs a value which is indicative of the total light energy absorbed by the pixel during a defined acquisition time. This acquisition time, may, for example, be set to one millisecond. Each pixel also has a maximum output value, and may therefore saturate if the light intensity is too high or the acquisition time is too long. To maximize signal to noise ratio, it is preferable for each pixel to approach output saturation with each acquisition in the condition of no ink between the light source and the pixel. The presence of ink will attenuate the light intensity over the acquisition period, and the pixel output will be reduced in accordance with the absorbance of the ink above the pixel at the wavelength range being emitted by the particular illuminated LED. If the pixel becomes saturated or over-saturated when illuminated through clear film, the intensity reduction due to the presence of ink on the film will be measured incorrectly or may go entirely undetected.

Proper calibration of the system is possible in one advantageous embodiment by placing a segment of clear film over the detector, setting the acquisition time for each pixel at one millisecond, and adjusting the on-time of each LED independently such that during the one millisecond acquisition time, the pixels of the array get near, but do not reach saturation for each color illumination. In this embodiment, the intensity of the LEDs should be high enough to saturate the pixels of the array if they are on during the entire one millisecond acquisition time period. To calibrate the system, the on-time of each LED is then reduced to less than one millisecond, such that during the one millisecond acquisition time (which will include some LED off-time when no LED light is striking the pixel) each pixel output is slightly less than saturation. During a preliminary calibration operation, for example, one of LEDs may be turned on for the full one millisecond acquisition period, and the pixel outputs tested. This should result in an array output indicating the highest possible light intensity measurement. Following this, the same LED may be turned on for 0.95 milliseconds, and the pixel outputs tested again. If the pixels are still saturating, the LED may be turned on for 0.90 milliseconds of the acquisition period, and so on, until an LED on-time is found which results in an output reading lower than saturation. The same sequence is repeated separately for all three of the LEDs, and the determined optimal on-times are used for subsequent data gathering operations concerning ink deposited on the film. This compensates for differences in light intensity between different LEDs, different response of the array at different wavelengths of incident light, etc. satisfactory LED on times are typically in the range of 0.5 to 1 millisecond.

Figure 6:
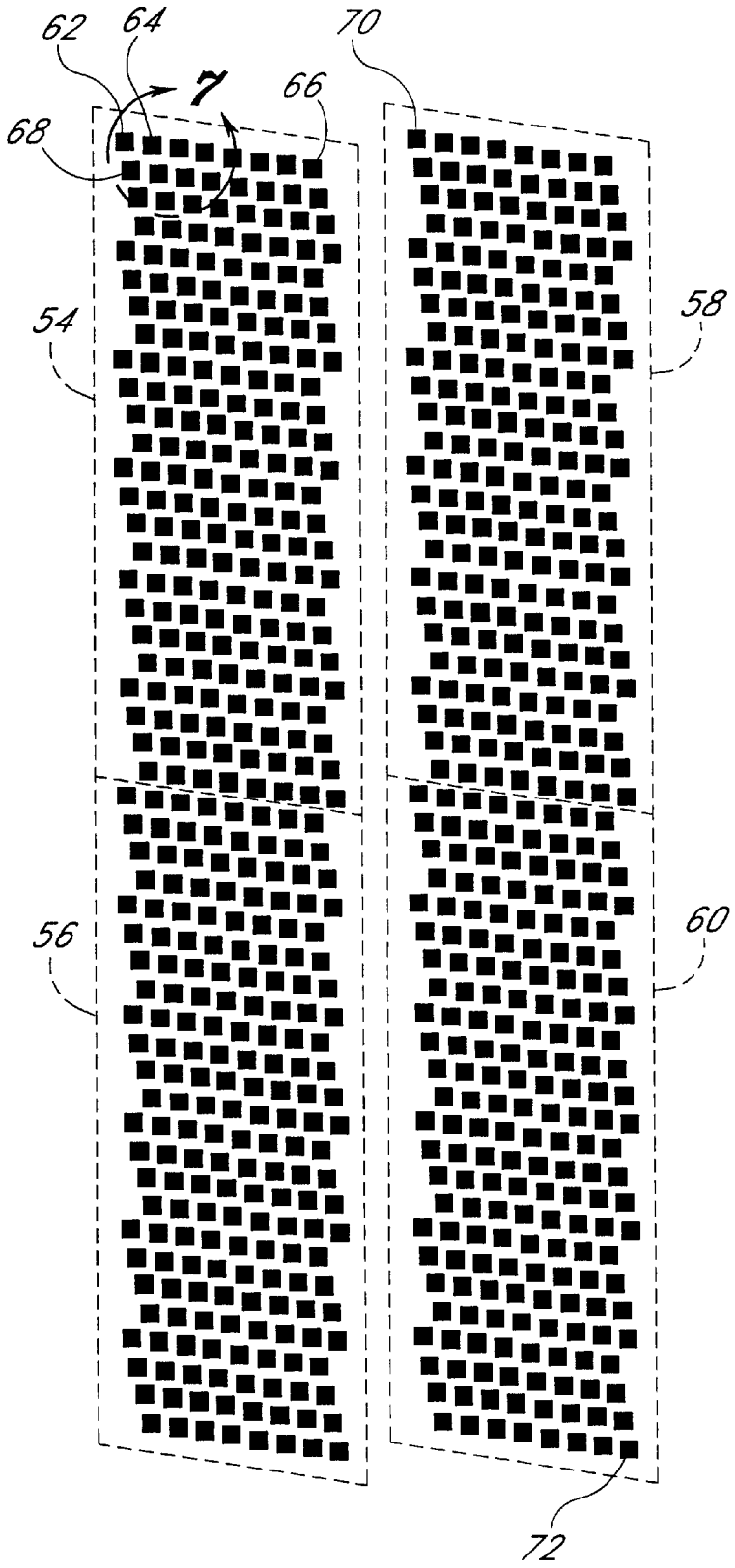
FIG. 6 illustrates a drop deposition pattern that may be printed on the substrate of FIGS. 1–3 for subsequent analysis.

FIG. 6 illustrates one advantageous pattern of ink deposition in the region 26 on the film 18. It will be appreciated that many different ink deposition patterns may be used. The most advantageous pattern will depend on the number and configuration of nozzles utilized by the printer, and it will be appreciated that a wide variety of ink deposition patterns may be utilized within the scope of the invention. In general, it is advantageous to use a pattern which can be printed quickly, which has a significant amount of ink deposited from each nozzle, and which includes a contribution from each nozzle which is located on the substrate in a manner as physically separate from the contribution from other nozzles as possible.

In the illustrated embodiment, the ink jet print head being functionally analyzed is a four color piezoelectric print head comprising a set of 192 ink ejection nozzles for each of the colors cyan, magenta, yellow, and black. These four sets are arranged as two columns of 384 nozzles each. The nozzle columns are separated by approximately ¼ inch, and the nozzle to nozzle spacing is 300 nozzles per inch, resulting in a column extent of about 1¼ inches. The upper 192 nozzles of the first column deposit droplets of cyan ink, and the upper 192 nozzles of the second column deposit droplets of black ink. The lower 192 nozzles of the first column deposit droplets of yellow ink, and the lower 192 nozzles of the second column deposit droplets of magenta ink.

Referring to the deposition pattern illustrated in FIG. 6, an advantageous printed pattern comprises a plurality of square arrays of deposited ink droplets. The two nozzle columns may deposit approximately rectangular arrangements of squares of deposited ink which are horizontally spaced. Because each nozzle column includes a set of nozzles for two colors, each horizontally spaced rectangular pattern is made up of two vertically adjacent rectangular patterns of different colors. Nozzle column 1 thus prints a set of 192 cyan squares 54 and a set of 192 yellow squares 56. Nozzle column 2 prints a set of 192 black squares 58 and a set of 192 magenta squares 60. Each square comprises a 4×4 array of sixteen individual ink droplets, each droplet of which is ejected by a selected individual nozzle. The upper left cyan square 62 of the pattern deposited by the first nozzle column has its sixteen droplets deposited by nozzle 1 of the first nozzle column, the next cyan square 64 to the right has its sixteen droplets deposited by nozzle 2 of the first nozzle column, and so on down the upper row, such that the last cyan square 66 of the upper row of squares has its sixteen droplets deposited by nozzle 8 of the first nozzle column. The second row has its first square 68 deposited by nozzle 9 of the first column, and so on. The deposited squares of the second nozzle column are laid out in a similar format. The upper left black square 70 is deposited by nozzle 1 of the second nozzle column, and the lower right magenta square 72 is deposited by nozzle 384 of the second nozzle column. This pattern of squares can be printed with four passes of the print head across the substrate 18.

Figure 7:
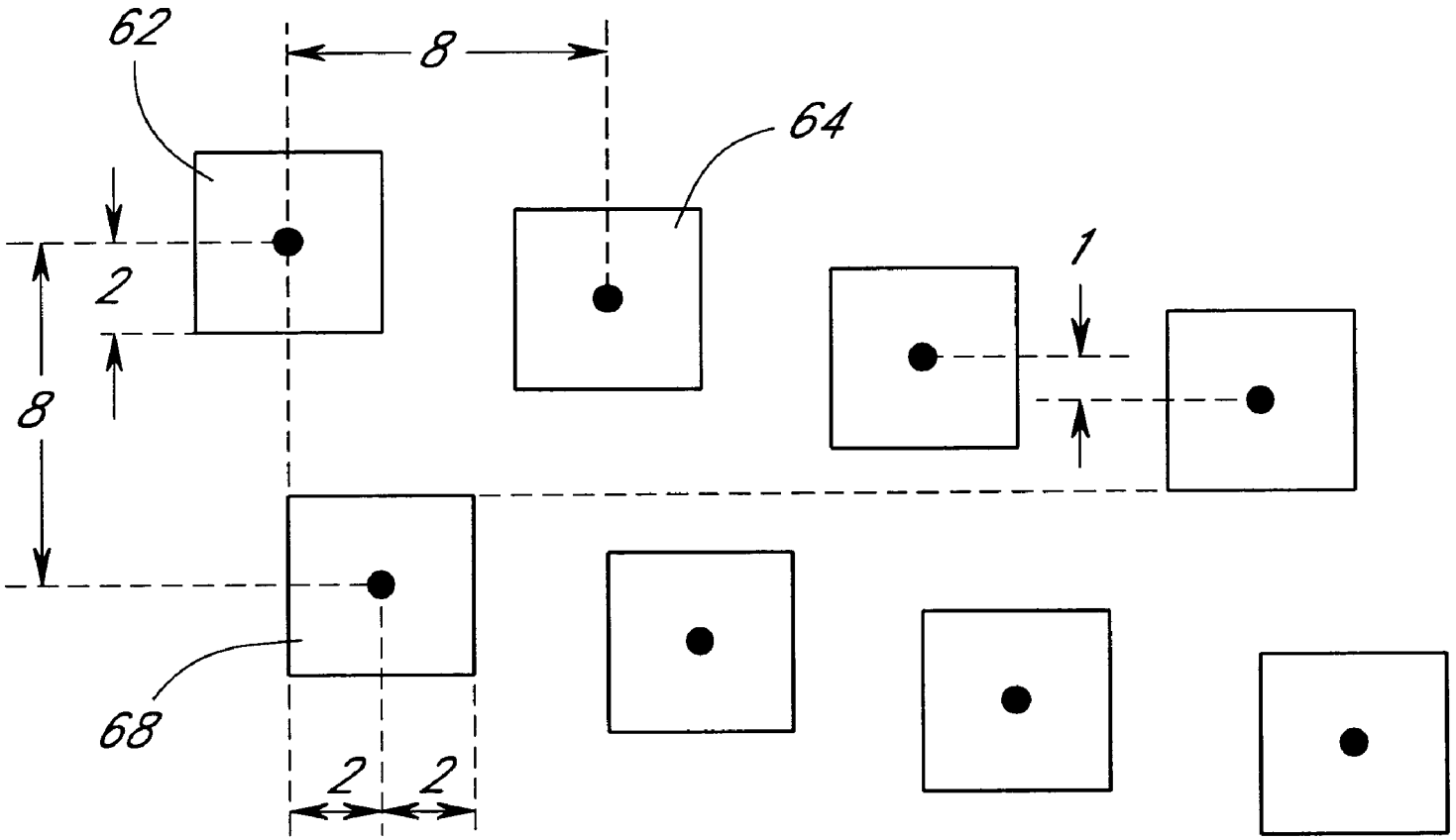
FIG. 7 is a detail view of region 7 of FIG. 6.

FIG. 7 illustrates a detail view of the eight upper left cyan squares of the array of FIG. 6, indicating the relative spacings, positioning, and size of the squares. As can be seen in both FIG. 6 and FIG. 7, the squares are deposited as staggered rows. Horizontally and vertically, center points of the squares are eight print resolution units apart (i.e. in a 300 dpi printer, they are 8/300 inches apart). As each square is four print resolution units by four print resolution units, the edges of the squares are separated by four print resolution units. Moving rightward down any given row, each deposited square is vertically positioned one print resolution unit below the square to the left. Moving downward from row to row, each square is positioned horizontally two print resolution units rightward from its nearest neighbor above. This pattern continues down four rows, at which point the fifth row downward is aligned horizontally with the first row. The squares are thus provided in groups of 32 (four rows of eight), such that the 192 nozzles of each color deposit six approximately trapezoidally shaped arrays of 32 squares each.

This array design has several benefits. It can be printed on a relatively narrow strip of transparent film of about 0.75 inches in width. Given the single print resolution unit downward increment with each square in a row, the entire array may be printed with four passes of the print head over the strip. In the first pass, the top four droplets are of each square are deposited, and the film is incremented by 1/300 inches. In the following three passes, the second, third, and fourth set of four droplets which complete each square are deposited. Furthermore, and as will be explained in additional detail below, the multiplicity of staggered groups of 32 squares reduces the chance of ambiguous interpretation of ink deposition during subsequent digitally implemented analysis.

As described above, digital image acquisition is performed by incrementing the film with the deposited pattern of droplet arrays past the optical detector. During this process, the film is advanced such that the optical detector is initially slightly below the bottom of the pattern of droplet arrays. Three acquisitions of intensity data, one each under red, green, and blue illumination is then performed, and the output of each pixel is stored in memory in the printer. The film is then incremented, and the three acquisitions are repeated. This process continues until three complete two dimensional images of the region of deposited ink has been formed. Each of these images comprises a 256 wide by 450–500 pixel long array of 8-bit light intensity values, wherein a low pixel brightness value indicates high absorbance of incident light due to the presence of deposited ink between the LED and the photodetector. One benefit of the present system is the speed of data acquisition. Each pixel row requires approximately three milliseconds for three data acquisition steps. At 300–600 increment steps per inch, the film 18 can be scanned over the optical detector at a speed of approximately 1.5 to 2.5 seconds per inch. This results in a total acquisition time of less than five seconds for the pattern pictured in FIG. 6.

After the three digital images are acquired the data is analyzed so that nozzle performance may be characterized.

Initially, however, the acquired digital image data is preferably normalized to account for variations in output dynamic range actually available at each pixel location. This my be done by performing a measurement of pixel output under no illumination (all LEDs off) to obtain a background measurement for each pixel, and also, for each color LED, performing a measurement of pixel output through clear substrate with no ink, to obtain the maximum output with zero ink attenuation for each pixel. For an 8-bit pixel, these values are ideally 0 and 255 respectively, but will in reality deviate from these numbers. These measurements may be made immediately prior to each image acquisition procedure.

Each raw pixel data value retrieved during the image acquisition process may then be scaled with the following formula:

$$I_{normalized}=255(I_{measured}-I_{minimum})/(I_{maximum}-I_{minimum}) \quad (1)$$

where $I_{minimum}$ and $I_{maximum}$ are the background and maximum value measurements made prior to image acquisition.

To map the center positions of the deposited 4 by 4 arrays of ink, it is advantageous to process the scaled image data by combining the values of identical pixel locations from all three acquired images to produce a single grayscale digital image representative of the "total" attenuating power of the ink at each pixel location. To enhance contrast, this combination of the three digital images may be performed by, for each pixel, multiplying the red, green, and blue attenuations, and dividing by the square of 255. Thus, each pixel of the grayscale image is assigned a value according to the values of the corresponding pixel in the red, green, and blue illuminated images as follows:

$$I_{combined}=(I_{normalized,\ red})(I_{normalized,\ green})(I_{normalized,\ blue})/(255)^2 \quad (2)$$

These combined grayscale pixel values may then be inverted to produce a measure of the total attenuating power:

$$\text{attenuating power}=P=255-I_{combined} \quad (3)$$

After this manipulation, each pixel value represents a normalized measure of total attenuating power of the ink on the substrate 18, with a larger pixel value corresponding to higher light absorption by the ink at that pixel location.

Figure 8:
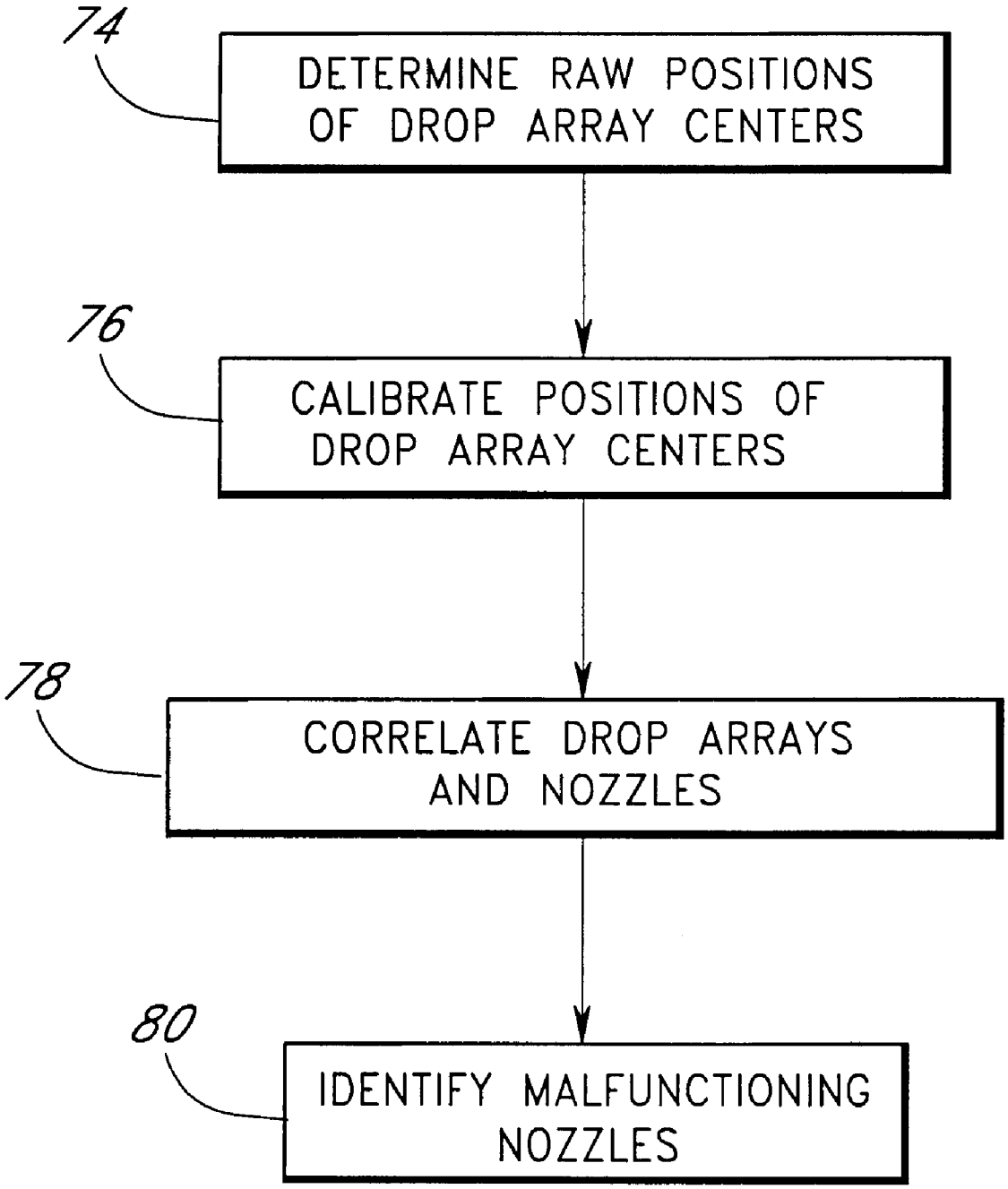
FIG. 8 is a flow chart of a method of droplet deposition pattern analysis in one embodiment of the invention.

It will be appreciated by those of skill in the art that many algorithms for analyzing a digital image of ink deposition may be devised. In the embodiment described below, the analysis comprises identifying local maximums of attenuating power, and mapping these local maximums onto a coordinate system. One embodiment of this process is illustrated by the flowchart of FIG. 8. Referring to this Figure and the deposition pattern illustrated in FIGS. 6 and 7, at step 74 the raw positions of the centers of the four by four droplet arrays are determined within the acquired image. Next, at step 76, these raw position values are calibrated. This calibration may involve shifting and scaling of the raw center position values to map the deposition pattern as a whole to a previously defined absolute location within the entire acquired image. At step 78, the detected four by four droplet arrays are correlated to specific nozzles. At step 80, malfunctioning nozzles are detected.

One specific implementation of these steps is described below with reference to FIGS. 9A–9C and 10. In one embodiment, blocks of 36 pixels of the two-dimensional grayscale image produced by the pixel value scaling and combining described above may be analyzed in a manner illustrated in FIGS. 9A through 9C. In this specific embodiment, a sum of the intensity values of the upper left 36 pixel block (designated 82 in FIG. 9A) of an image is calculated. As the upper left corner should include no deposited ink, this will be a small number, because each pixel should represent near zero attenuating power. Next, the 36 pixel block is moved to the right three pixels, and the sum is performed again. Once again, as no portion of the image of deposited ink appears in this block, the sum will be small. This is continued across left half of the 400 pixel width of the image such that the right column of squares is initially not considered. The 36 pixel block is then moved back to the left side of the image and downward by three pixels to position 84 of FIG. 9A. A sum of the intensity levels of each pixel in the 36 pixel block is again performed, and the block is shifted over three pixel columns at a time, re-performing the sum at each location. Each time the sum is performed, its value is compared to a threshold, to determine whether or not the 36 pixel block overlaps one of the four by four arrays of droplets. The threshold should be low enough to detect overlap of deposited squares, but high enough to reject noise which doesn't correspond to deposited ink.

Figure 9A:
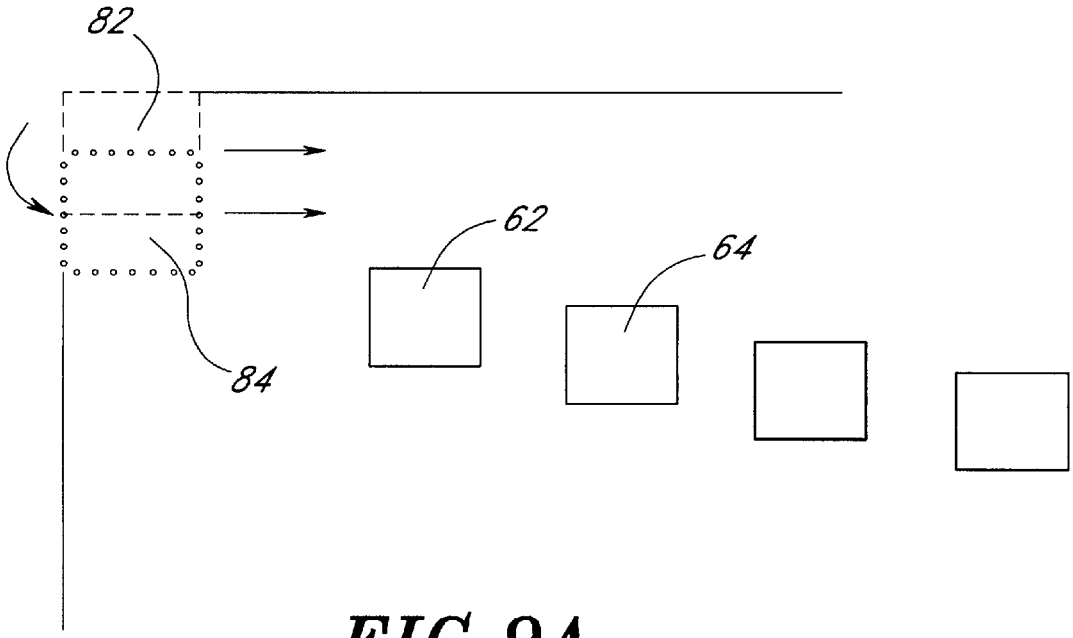
FIGS. 9A–9C is an illustration of the determination of raw droplet array positions in one embodiment of the invention.
Figure 9B:
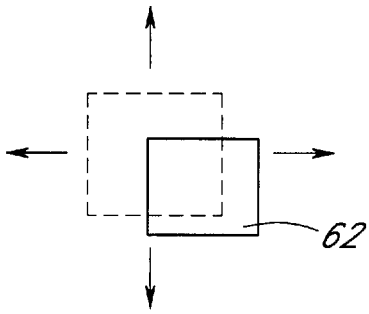

Thus, and as shown in FIG. 9B, as the analyzed pixel block begins to overlap with the image of the upper left deposited ink square 62, the value of the sum will increase. Once the sum exceeds the threshold, the system has "found" a droplet array, and the location of the 36 pixel block at which the threshold was first exceeded is stored.

Figure 9C:
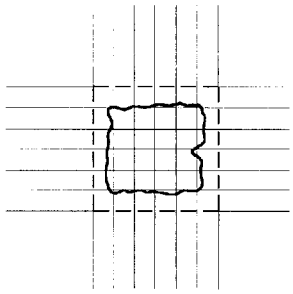

Once a droplet array has been found, the analyzed block is shifted by one pixel in all four directions and is moved one pixel in the direction which produced the largest increase in the calculated pixel value sum for the block. This step is repeated until movement in all four directions produces no increase in pixel value sum, thus locating the position at which the 36 pixel value sum is a local maximum. This position is illustrated in FIG. 9C.

As shown in this Figure, the image of the 16 droplet square which is deposited at 300 dpi takes up a square area of approximately 5.3 pixels horizontally, and 4 pixels vertically, if the horizontal resolution (determined by the resolution of the photodiode array) is 400 dpi and the vertical resolution (determined by the increment distance during image acquisition) is 300 dpi as described above. It can thus be appreciated that the 36 pixel block is sized so as to be larger than the expected size of an imaged 4 by 4 droplet array, but not so large as to be likely to overlap more than one imaged droplet array during this process. With different droplet deposition patterns and/or horizontal and vertical resolutions, the block size may be altered to be larger, smaller, rectangular in shape, etc., in accordance with these parameters.

Once a 36 pixel block is identified which corresponds to a local maximum for the sum of the 36 pixel values, the center of the image of the deposited ink square 62 is defined by a center-of-gravity calculation which locates a weighted droplet array "center" to a resolution which is more accurate than the resolution of image acquisition. Thus, in this embodiment of the invention, the location of the center of the ink droplet is calculated as:

$$\text{horizontal position}=\Sigma_i(x_iP_i)/\Sigma_i(P_i) \quad (4)$$

$$\text{vertical position}=\Sigma_i(y_iP_i)/\Sigma_i(P_i) \quad (5)$$

where the sums are performed over the 36 pixel block.

Once this is calculated, this information is made part of a first entry in a list of detected droplet arrays. The entry includes the weighted position of the droplet array as calculated with equations (4) and (5) above, as well as separate entries for the red, green, and blue normalized light intensities at each of the 36 pixels in the block calculated in accordance with equation (1) above.

After creating this list entry, the values of each of the 36 pixels in the block are set to zero so that the same droplet array is not detected again. The 36 pixel block is then moved back to the stored location where the threshold sum was first exceeded, and is moved rightward and downward as above until it begins to overlap the next ink square image 64. The pixel summing and weighted center point determinations described above are repeated for the second ink square image 64, and a second list entry is made. The process is repeated until the 36 pixel block reaches the lower right portion of the left half of the image, and all of the droplet arrays in the left column have been detected, assigned a center point position, and form an entry in the list of detected droplet arrays.

At this point, only a list of detected arrays and their positions has been produced. No assessment has been made with regard to which nozzle deposited which droplet array or whether or not any of the droplet array locations are correct. Because an unknown number of nozzles may be firing improperly or not at all, it is advantageous to analyze the list of detected droplet array positions as a whole in some way to orient and position the entire deposited pattern to an appropriate location within the acquired image. After this has been done, it is possible to accurately compare measured droplet array center point locations with absolute locations expected for properly firing nozzles. As a specific example of the orientation procedure, reference is made below to FIG. 10, which shows a deposited pattern which was printed by a print head having eight malfunctioning nozzles which did not eject ink during the deposition process.

Calibration of raw center point locations may be performed with an initial bubble sort of the list of detected droplet arrays to place them in left to right and top to bottom order. The sort will thus place any given detected droplet array lower down the list than all other detected droplet arrays which are leftward in the same row, or which reside in a vertically higher row. Using the droplet array detection procedure described above with reference to FIGS. 9A–9C, this is the order in which the droplet arrays should have been found, but improper nozzle firing may cause the order to deviate from this desired order.

The bubble sort may be performed by a pairwise comparison of droplet array x and y center point locations. The comparison may begin with the first two detected droplet arrays on the list. After these are compared and ordered, the third list entry is compared with the second, and these two are ordered. If this ordering results in a shift of list position such that the third detected droplet array becomes the second list entry, and the second becomes the third, then the new second list entry is compared to the first list entry. The fourth is then compared with the third and ordered, etc.

The numerical comparison may be performed by first comparing the raw vertical positions of the two list entry center points. If the two y-positions differ by more than a selected threshold amount, the list entry with the higher y-position (upward in FIGS. 6 and 7) is listed above the other. For the pattern of droplet arrays illustrated in FIGS. 6 and 7, this threshold amount may be chosen to be one half of the vertical pitch of the pattern. As seen in FIG. 7, the vertical pitch is eight pixel locations, so the threshold may be selected to be four pixel locations. Therefore, if the y-position of the droplet array centers differ by more than four pixel locations, the droplet array with the higher y-position is ordered first.

If the y-positions of the list entries are closer than the four pixel location threshold, which will generally be true for adjacent droplet arrays in the same row, an ordering based on x-position is performed. In this case, if the two list entries are representative of droplet arrays in the same row, the list entry with the lower x-position (leftward in FIGS. 6 and 7) should be first. If instead the comparison is being performed between the last droplet array of one row and the first droplet array of the next row, the list entry with the highest x-position (rightward in FIGS. 6 and 7) should be first. These two possibilities are distinguished by using the fact that the staggered pattern of FIGS. 6, 7, and 10 produces a reduction in center point y-position of about double the height of the drop arrays when moving from the left side of a row to the right side of a row. When performing list entry comparison for list entries having similar y-positions, the y-position of the list entry with the low x-position is recalculated using the known stagger angle to produce the expected y-position of this list entry if its x-position were equal to the x-position of the list entry with the higher x-value. If the two list entries being compared are in the same row, this should produce nearly identical y-positions. On the other hand, if the list entry with the lower x-value is in the next row down, the recalculated y-value will be significantly lower than the y-value of the higher x-value list entry. Thus, if this recalculation of y-position produces a deviation of less than the four pixel positions between list entries, the list entry with the lower x-value is placed first. If this recalculation of y-position produces a deviation of more than the four pixel positions between list entries, the list entry with the higher x-value is placed first.

Performing this pairwise comparison for adjacent list entries all the way down the list, an ordered list of detected droplet arrays (and associated center point and attenuation information) is produced. Within this ordered list, complete single rows of eight droplet arrays may then be identified. This can be done by starting with the first list entry, and counting how many list entries are below it before a list entry which moves leftward in x-position is encountered. In the example pattern of FIG. 10, the first row 90 will be tagged as complete because the x-position of the first eight list entries will continually increase, and the ninth entry will have a significantly lower x-value than the eighth. The second row 92, which includes a missing array 94 because of malfunctioning nozzle 14, will not be tagged as complete because only seven list entries will be present before a leftward jump in x-position is encountered. This process is continued until all instances of complete rows have been identified. For each complete row of eight, the average x-position of the droplet arrays in the row is calculated and stored.

Figure 10:
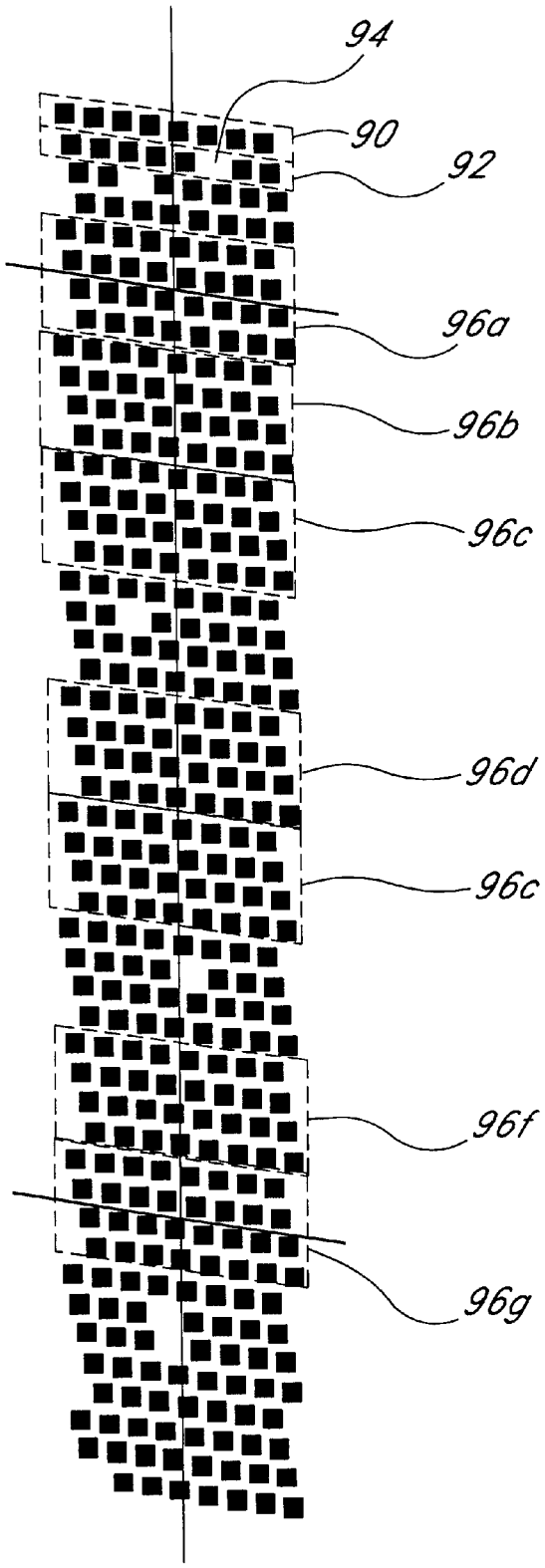
FIG. 10 is an illustration of the calibration of droplet array positions.

Next, complete trapezoidal blocks of 32 droplet arrays are identified. This may be done by analyzing adjacent sets of four complete rows identified as described above. If the average droplet array x-position which was previously stored increases continuously for all four rows without taking a leftward jump to a lower x-value, then the four rows comprise one complete trapezoidal block. In FIG. 10, seven such complete blocks of 32 are present, designated 96*a–g*.

To calibrate the x and y center positions of the detected droplet arrays which are stored in the list entries, the average x-position and average y-position of the 32 list entries for the highest complete block of 32, designated 96*a* in FIG. 10, is calculated. The same calculation is also performed for the lowest complete block of 32 list entries, designated 96*g* in FIG. 10. These calculations may result in x and y locations for these blocks which differ from their ideal expected positions. The entire pattern may be shifted slightly to the left, right, up, or down, for example. In addition, if the film 18 is incremented in steps which are slightly longer or shorter than expected during image acquisition, the image may be stretched or compressed in the vertical dimension.

To correct for these possibilities, and to position the pattern within the image so that more accurate and meaningful comparisons may be made between actual and expected droplet deposition, the x-positions and y-positions of all list entry center points are calibrated. First, the raw x and y position values are shifted by the amount required to place the average x-position and average y-position of the 32 droplet arrays of the highest complete trapezoidal block in exactly its expected location. This positions the pattern in a specific absolute location within the entire acquired image.

To address potential expansion or compression of the pattern, the y-positions for all list entry positions are shifted by an amount which increases linearly away from the ideal y-position of the upper block 96*a* and which forces the average y-position of the lowest complete block 96*g* to exactly its ideal expected y-position. These calibrated values are then used for further deposition analysis.

So far in the analysis routine, the list entries have not been associated with nozzles. Once calibrated center point positions for each droplet array are computed as described above, the list entries may be associated with nozzles. In one embodiment, this is done by comparing the calibrated center point data for each detected droplet array and comparing them to the ideal expected center point positions for all print head nozzles. This may be done by taking the center point data for the first list entry and finding the closest match among the list of ideal positions. The nozzle associated with the closest matching ideal position is assigned to the first list entry. The same procedure is then performed with the second and subsequent list entries. If the closest match is from a nozzle which has already been assigned to another list entry, it is determined which of the two list entries is a closer match, and that nozzle is assigned to that list entry. Each list entry may thus be supplemented with a nozzle identification and an ideal expected center point location.

Of course, if some nozzles are not ejecting ink at all, there will be fewer list entries than nozzles. In the example of FIG. 10, for instance, there will be 384 nozzles to be assigned and 376 list entries. Thus, once the nozzle assignment process is complete, eight unassigned nozzles will remain. These nozzles are identified as malfunctioning nozzles by the system. Another calculation which may be performed is a comparison of measured droplet array center point and ideal droplet array center point. If the distance between these values is greater than a threshold, the nozzle may also be identified as malfunctioning. Because attenuating power across the entire droplet array is also stored as part of the list entry, nozzles which are ejecting too little ink may be identified as malfunctioning. Furthermore, the color specific attenuation data can be utilized to ensure that the ink color is within specified limits.

Once malfunctioning nozzles have been identified, various servicing methods may be attempted to either correct or compensate for the nozzle problems. In piezoelectrically actuated print heads, a nozzle which is ejecting misdirected droplets can often be repaired by forcing ink through the nozzle to remove trapped air or particulate material which may be interfering with droplet ejection. Forcing ink through the print head may also fix nozzles which are not ejecting any ink at all, by removing a nozzle blockage, for example. Nozzles which cannot be repaired by running such a service routine may be replaced by using either extra nozzles to compensate for the malfunctioning nozzles or by increasing the duty cycle of other nozzles in a multi-pass printing mode. One example of such a compensation scheme is provided by pending U.S. patent application Ser. No. 09/127,397, entitled Open Jet Compensation During Multi-Pass Printing, and filed on Jul. 31, 1998. The entire disclosure of the Ser. No. 09/127,397 patent application is incorporated herein by reference in its entirety.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. An ink jet printer with fast and inexpensive droplet deposition analysis capability, said ink jet printer comprising:

a platen having a slot therein;

a supply reel mounted in said platen;

a strip of substantially flexible transparent film extending from said supply reel, across said platen, and into said slot;

a film drive capstan and pinch roller mounted beneath said slot and accepting said film therebetween;

a light source and an optical detector mounted adjacent to said drive capstan and said pinch roller such that said film may be advanced past said optical detector by said drive capstan while being illuminated by said light source; and a processor coupled to receive an output of said optical detector as said film is advanced past said optical detector, wherein said processor is configured to create one or more images of an array of ink droplets on said film by said ink jet printer, wherein said processor is configured to map said one or more images onto a coordinate plane, and wherein said processor is configured to detect missing and inaccurately positioned droplets relative to said coordinate plane.

2. A droplet analysis system for an ink jet printer comprising:

a strip of flexible and substantially transparent film;

a light source on a first side of said film;

an optical detector on a second side of said film opposite said first side; and a processor coupled to receive an output of said optical detector representative of an image of an array of ink droplets on said film, and wherein said processor compares positions of the ink droplets in the array on said film with expected positions to detect missing or inaccurately positioned droplets.

3. The droplet analysis system of claim 2 wherein said light source is mounted on a moveable print carriage.

4. The droplet analysis system of claim 2 wherein said light source is mounted to a stationary portion of said ink jet printer.

5. The droplet analysis system of claim 2, wherein said light source comprises a plurality of light sources of different colors.

6. The droplet analysis system of claim 5, wherein said plurality of light sources comprise a red light-emitting-diode, a green light emitting diode, and a blue light emitting diode.

7. The droplet deposition apparatus of claim 2, additionally comprising at least one color filter positioned between said light source and said optical detector.

8. The droplet analysis system of claim 7, wherein said color filter is positioned between said film and said optical detector.

9. The droplet analysis system of claim 7, wherein said color filter is integral to said film.

10. The droplet analysis system of claim 2, wherein said optical detector comprises a color CCD array.

11. The droplet analysis system of claim 2 wherein said optical detector comprises a linear array of photodiodes.

12. The droplet analysis system of claim 11, wherein said linear photodiode array resolution is at least approximately equal to the ink jet printer resolution.

13. The droplet analysis system of claim 11, wherein said linear photodiode array comprises approximately 400 pixels per inch or more.

14. The droplet deposition apparatus of claim 2, wherein said optical detector comprises a linear CCD array.

15. The droplet analysis system of claim 2, wherein a portion of said film is wound onto a supply reel.

16. The droplet analysis system of claim 15, additionally comprising a receptacle configured to collect film previously advanced over said optical detector.

17. The droplet deposition apparatus of claim 16, wherein said supply reel is mounted in a platen of the ink jet printer.

18. A method of analyzing ink droplet deposition in an ink jet printer comprising:

depositing a set of ink droplets onto a strip of flexible and substantially transparent film;

illuminating said film with light;

detecting intensity of light passing through said film at a plurality of locations on said film;

using detected light intensity at said plurality of locations to detect missing or inaccurately positioned droplets.

19. The method of claim 18, wherein said light comprises light in one or more selected frequency bands.

20. The method of claim 19, wherein said light comprises red, green, and blue light.

21. The method of claim 18, additionally comprising filtering the light as it passes through said film prior to detecting the intensity.

22. A method of servicing an ink jet print head comprising:

positioning said ink jet print head over a portion of a print surface which comprises a first segment of substantially transparent flexible film;

depositing a first set of ink droplets onto said first segment of substantially transparent film;

analyzing said first set of ink droplets;

performing a service routine on said ink jet print head;

advancing said substantially transparent film such that a second segment of said substantially transparent film is positioned at said portion of said print surface;

positioning said inkjet print head over said portion of said print surface;

depositing a second set of ink droplets onto said second segment of substantially transparent film without removing said first set of ink droplets;

analyzing said second set of ink droplets.

23. The method of claim 22, additionally comprising forcing ink through said ink jet print head after depositing said first set of ink droplets and before depositing said second set of ink droplets.

24. In an ink jet printer, a method of detecting malfunctioning ink ejection nozzles of a print head, said method comprising:

depositing a pattern of ink droplets onto a flexible and substantially transparent film with said print head;

acquiring a digital image of said pattern;

analyzing pixel values of said digital image so as to identify features of said pattern which are indicative of malfunctioning ink ejection nozzles.

25. The method of claim 24 wherein said depositing comprises ejecting ink droplets onto a substantially transparent substrate.

26. The method of claim 24, wherein said acquiring comprises advancing said deposited ink droplets past an optical detector.

27. An ink jet printer comprising:

a platen having an opening therein;

an optical detector mounted-beneath said opening; and a light source mounted beneath said opening, a flexable film threaded through said opening and between said optical detector and said light source, and a processor coupled to receive an output of said optical detector representative of an image of an array of ink droplets on said film, and wherein said processor compares positions of the ink droplets in the array on said film with expected positions to detect missing or inaccurately positioned droplets.

28. The ink jet printer of claim 27, wherein the film is a substantially transparent strip of flexible film.

29. The ink jet printer of claim 28, additionally comprising a drive capstan in contact with said film to advance said film past said optical detector.

30. The ink jet printer of claim 29, wherein said optical detector comprises a linear array of photodiodes oriented transverse to the direction of advance of said substantially transparent film.

31. A method of servicing a droplet deposition system in an ink jet printer comprising:

removing a substantially empty transparent film supply reel from a mounting bay in a print surface of said ink jet printer, wherein said print surface is adjacent to a path of substrate material during normal printing operations;

installing a second supply of substantially transparent film into said mounting bay; and threading an end of the second supply of substantially transparent film through a slot in said print surface such that said film passes between a light source and an optical detector.

32. A method of ink jet printing comprising:

depositing an array of ink droplets onto a flexable transparent substrate;

passing light through said transparent substrate and into an optical detector so as to detect said array of ink droplets;

mapping said array of ink droplets onto a coordinate field; and detecting at least one ink droplet which is incorrectly placed relative to said coordinate field.

33. The method of claim 32, additionally comprising servicing an ink jet print head in response to said detecting.

* * * * *